US008037559B2

(12) United States Patent
Niwa et al.

(10) Patent No.: US 8,037,559 B2
(45) Date of Patent: Oct. 18, 2011

(54) VARIABLE POSTURE BED

(76) Inventors: Toshihiro Niwa, Ichinomiya (JP); Shoko Niwa, Ichinomiya (JP)

( * ) Notice: Subject to any disclaimer, the term of this patent is extended or adjusted under 35 U.S.C. 154(b) by 227 days.

(21) Appl. No.: 12/375,939

(22) PCT Filed: Sep. 20, 2007

(86) PCT No.: PCT/JP2007/068914

§ 371 (c)(1),
(2), (4) Date: Feb. 2, 2009

(87) PCT Pub. No.: WO2009/037792

PCT Pub. Date: Mar. 26, 2009

(65) Prior Publication Data

US 2010/0223724 A1 Sep. 9, 2010

(51) Int. Cl.
*A47B 7/02* (2006.01)

(52) U.S. Cl. ..... 5/609; 5/608; 5/611; 5/618

(58) Field of Classification Search ..... 5/607–619
See application file for complete search history.

(56) References Cited

U.S. PATENT DOCUMENTS

| | | | | |
|---|---|---|---|---|
| 3,247,528 | A * | 4/1966 | Swenson et al. | 5/658 |
| 3,879,772 | A * | 4/1975 | Pol | 5/615 |
| 3,900,906 | A * | 8/1975 | Berthelsen | 5/608 |
| 4,152,795 | A * | 5/1979 | Rodosta et al. | 5/658 |
| 5,385,153 | A | 1/1995 | Jamieson et al. | |
| 5,535,464 | A * | 7/1996 | Salonica | 5/604 |
| 6,505,363 | B2 * | 1/2003 | Davis | 5/118 |
| 7,146,662 | B1 * | 12/2006 | Pollard et al. | 5/617 |
| 7,305,727 | B2 * | 12/2007 | Horlin | 5/607 |
| 2004/0015320 | A1 | 1/2004 | Nagaoka et al. | |

FOREIGN PATENT DOCUMENTS

| | | |
|---|---|---|
| CH | 577 312 | 7/1976 |
| JP | 2000 135260 | 5/2000 |
| JP | 2001 95858 | 4/2001 |
| JP | 2003 265543 | 9/2003 |
| JP | 3109259 | 5/2005 |
| WO | WO 97/29668 | 8/1997 |
| WO | WO 00/66061 | 11/2000 |

OTHER PUBLICATIONS

Extended European Search Report issued Apr. 13, 2011, in European Patent Application No. 07828657.

* cited by examiner

*Primary Examiner* — Robert G Santos
*Assistant Examiner* — Nicholas Polito
(74) *Attorney, Agent, or Firm* — Oblon, Spivak, McClelland, Maier & Neustadt, L.L.P.

(57) ABSTRACT

A variable posture bed includes a base rest located on a floor surface; a bed board arranged in a horizontal state above and opposite the base rest; a connection support portion disposed at the center of the base rest between the base rest and the bed board and that supports the bed board to be vertically movable in all directions around the center thereof; connection support portions disposed at four corners of the base rest and the bed board and that support the bed board to be vertically movable; and a drive control device that continuously moves the bed board in the vertical direction with a predetermined operation pattern and that limits the vertical movement of the head side of the bed board between the horizontal position and a predetermined upper position.

36 Claims, 9 Drawing Sheets

VARIABLE POSTURE BED

TECHNICAL FIELD

The present invention relates to a variable posture bed which automatically changes the posture of a person lying on the bed.

BACKGROUND ART

People are always affected and fatigued by gravity. Even in the state of lying down, the fatigue decreases but does not completely disappear. Therefore, in order to reduce the burden caused by gravity and to maintain a good sleep, a person moves his or her body by performing a postural change such as a roll-over (hereinafter, described as the postural change) even during sleep. Normally, the postural change is performed dozens of times a night. When a person is in poor physical condition or ill, the number of postural changes increases than usual, which may cause more fatigue and lack of sleep. Further, a person in a severe bedridden state has difficulty performing the postural change by oneself. Accordingly, there is a problem that bedsores are developed at the pressured part by gravity. In addition, there is another problem that, due to gravity, bone structures are distorted, skin, muscles and internal organs are stressed, and blood flow and lymph flow are inhibited by keeping the same posture for a long time, which may cause various diseases. Further, such a seriously ill person requires postural change to be frequently performed about every two hours by a care-giver, which is very heavy work for the care-giver. As a result, there is a problem that the care-giver's workload hugely increases and the care-giving cost therefor becomes very high.

For example, an electrically operated rocking bed is disclosed in Japanese Utility Model Registration No. 3122978. In the electrically operated rocking bed, a suspending pillar is vertically disposed at each of the four positions of a bed base at both of the front and rear sides, and a pillar for the suspension is disposed under a board of the bed. A suspension is slung between the suspending pillar and the pillar so that the suspension can support a force. A projecting wheel is disposed at the shaft of the motor and fixed in a transmitting frame which is disposed at a corresponding position under the board. When the motor-driven projecting wheel starts and rotates, the electrically operated rocking bed receives the reciprocating motion of the projecting wheel and rocks in the front-rear direction and the right-left direction. This bed, however, rocks the board in the front-rear direction and the right-left direction, not performing the postural change to a person lying on the board. Further, such rocking motion in the front-rear and right-left directions is apt to affect the brain, the semicircular canal of the ear, the otolith, and the like. Therefore, there is a problem that motion sickness symptoms, such as dizziness, nausea, and discomfort, are apt to occur. A rocking baby bed and a bed rocking apparatus which have similar structures to the abovementioned are respectively disclosed in Japanese Patent Application Laid-Open No. 2004-229784 and Japanese Utility Model Registration No. 3096816.

Also, Japanese Patent Application Laid-Open No. 8-117293 discloses a lengthwise motion rocking bed. The length motion rocking bed performs a lengthwise motion in which both of the front and rear sides of the rocking frame of the bed vertically moves around the center in the lengthwise direction and a widthwise motion in which both of the right and left sides vertically moves around the center in the widthwise direction. However, this rocking bed is not only incapable of performing the postural change in the case of the lengthwise motion but also shakes the head downward from the horizontal state, and therefore, is apt to affect the brain, the semicircular canal of the ear, the otolith, and the like. Accordingly, there is a problem that motion sickness symptoms, such as dizziness, nausea, and discomfort, are apt to occur. In the case of the widthwise motion, although the postural change can be performed, there is no motion in the lengthwise direction. Accordingly, the blood flow etc. in the lengthwise direction of the body is not promoted. Further, each of the right half and the left half of the head repeatedly falls below the horizontal state. As a result, since blood is apt to be gathered to the head, there are problems that motion sickness symptoms, such as dizziness, nausea, and discomfort, are apt to occur and further, that a cerebral blood vessel or a heart blood vessel is apt to be blocked.

The present invention is to solve the abovementioned problems, and an object of the invention is to provide a variable posture bed which can automatically and naturally perform the postural change such as roll-over.

DISCLOSURE OF THE INVENTION

In a variable posture bed of the present invention, a bed board is arranged in a horizontal state above and opposite a base rest placed on a floor surface, the bed board is supported on the base rest to be vertically movable in all directions around the center thereof by a connection support portion which is erected at the center of the base rest between the base rest and the bed board, the bed board is supported at four corners of the base rest by support members to be vertically movable, and the bed board is continuously moved in the vertical direction with a predetermined operation pattern while the vertical movement of a head side of the bed board is limited between the horizontal position and a predetermined upper position by a drive control device.

Further, a variable posture bed of the present invention comprises a base rest which is located on a floor surface, a bed board which is arranged in a horizontal state above and opposite the base rest, a connection support portion which is disposed at the center of the base rest between the base rest and the bed board and which supports the bed board to be vertically movable in all directions around the center thereof, support members which are disposed at four corners of the base rest and the bed board and which supports the bed board to be vertically movable, and a drive control device which continuously moves the bed board in the vertical direction in a predetermined operation pattern and which limits the vertical movement of the head side of the bed board between the horizontal position and a predetermined upper position.

In the present invention, the bed board is supported to be vertically movable in all directions by the connection support portion and supported at four corners of the base rest by the support members, and the bed board is thereby capable of being vertically inclined at the head side and the foot side around the connection support portion. Then, by moving the bed board vertically in the predetermined operation pattern with the drive control device while being in the state where the head side of the bed board is limited between the horizontal position and the predetermined upper position, the bed board can be vertically inclined around the connection support portion so that the head part is between the horizontal position and the predetermined upper position. It is thereby possible to ensure that a person lying on the bed board performs the postural change automatically and naturally to a person lying on the bed board while keeping his or her head at the position equal to or higher than the horizontal position.

Consequently, in the present invention, it is convenient because fatigue of a person lying on the bed board is eliminated naturally and effectively during sleep. Further, since the head part is always kept at the position equal to or higher than the horizontal state, the brain, the semicircular canal of the ear, the otolith, and the like are not subject to negative effects, and therefore, motion sickness symptoms, such as dizziness, nausea, and discomfort, do not occur.

Further, since it is possible for a seriously ill person who is bedridden and unable to perform the postural change by oneself to automatically perform the postural change without care-giver's help, bedsores can be prevented. In addition, it is possible to prevent the distortion of bone structure and inhibition of blood flow and lymph flow caused by stresses on skin, muscles and internal organs, which are caused by gravity, and various diseases caused thereby can be prevented. Further, the burden of care-giver's work for performing the postural change to a serious ill person can be greatly reduced and the care-giving cost therefor can be greatly reduced.

In the present invention, the bed board by the drive control device can be driven at both the left and right sides of the foot side position or at both the left and right sides of the head side position of the bed board. Since the bed board by the drive control device is thereby driven at both the left and right sides of the foot side position or at both the left and right sides of the head side position of the bed board which are close each other, the drive control can be easily performed.

In the present invention, it is preferred that the connection support portion comprises a lower connection support portion which is disposed on the base rest and an upper connection support portion which is disposed on a lower surface of the bed board and which front end side is engaged with the front end side of the lower connection support, the front end of one of the upper connection support portion and the lower connection support portion is formed as a hemispherically projecting portion, the front end of the other of the upper connection support portion and the lower connection support portion is formed as a hemispherically recessed portion to engage with the hemispherically projecting portion, and the upper connection support portion is made pivotable around the front end of the lower connection support portion. Since the lower connection support portion and the upper connection support portion which configure the connection support portion are thereby smoothly engaged with the hemispherically projecting portion and the hemispherically recessed portion at the front ends thereof, the bed board smoothly moves vertically in all directions thereof and comfortable sleep for a sleeper can be consequently assured.

In the present invention, the operation pattern may be configured to have a series of operations of one side of the left or the right of the head side of the bed board moving to an upper limit position, the other side of the left or the right of the head side moving to the upper limit position, one side of the left or the right of the head side moving to the horizontal position, and the other side of the left or the right of the head side moving to the horizontal position. Four corners of the bed board thereby vertically move sequentially counterclockwise or clockwise to ensure a person lying on the bed board undergoes natural and smooth postural change is performed to a person lying on the bed board. Therefore, the abovementioned effects of the postural change can be surely obtained.

In the present invention, it is preferred that the bed board is returned to the horizontal state when the operation of the operation pattern is stopped by the drive control device. Since a person lying on the bed board is thereby ensured not to be left in an unnaturally inclined state when the operation pattern by the drive control device is stopped and to be returned to the horizontal state, the variable posture bed can be safely used.

In the present invention, speed adjustment means for adjusting the speed of the operation of the bed board performed by the drive control device may be provided. This enables the user of the variable posture bed to adjust the speed of the operation of the bed board depending on the usage state or the physical condition, which is convenient. For example, in the case that the user uses the bed when sleeping or is in poor physical condition, the speed of the operation pattern is preferably to be set to 20 minutes or more per cycle. In a normal state where the user is awake during day time, about 10 minutes per cycle is preferred. Further, in the case that the postural change operation is performed for a light exercise of the whole body, the speed can be selected from the range between several seconds per cycle and several minutes per cycle in consideration of physical fitness and physical condition.

In the present invention, it is possible to dispose an upper body bed board for an upper body side and a lower body bed board for the lower body side which are located on the bed board pivotable around the middle position in the lengthwise direction, and to provide an upper body drive control device which controls upward movement and returning to the horizontal state of the upper body bed board and a lower body drive control device which controls upward movement and returning to the horizontal state of the lower body bed board. The upper body bed board and the lower body bed board which are located on the bed board are made vertically pivotable by the upper body drive control devise and the lower body drive control devise around the middle point in the lengthwise direction in accordance with the control of the vertical movement of the bed board by the drive control devise. Accordingly, the upper body bed board and lower body bed board can be inclined at a predetermined angle or can be in the inclined state or the horizontal state repeatedly.

In the present invention, it is possible that the upper body drive control device performs a keeping control to keep the upper body bed board in a stopped state at a predetermined height position and a vertical movement control to repeatedly perform the upward movement and the returning to the horizontal state, and the lower body drive control device performs a keeping control to keep the lower body bed board in a stopped state at a predetermined height position and a vertical movement control to repeatedly perform the upward movement and the returning to the horizontal state. By the keeping control, the upper body bed board can be raised and thereby a person lying on the bed board can have a meal etc. in a raised state. In addition, the lower body bed board can be raised and thereby a person lying on the bed board can be in a light exercise state by raising the lower body. Further, with the repeated movement of the upper body bed board or the lower body bed board between the predetermined height position and the horizontal state by the vertical movement control, a person lying on the bed can do light exercise while lying.

In the present invention, the lower body bed board is further divided into a left body portion of the left body side and a right body portion of the right body side, and the lower body drive control device may operate the left body portion and the right body portion simultaneously or separately. The left body portion and the right body portion can be thereby operated simultaneously or separately by the lower body drive control device, enabling the exercise of the left and right legs to be performed efficiently.

BEST MODE FOR CARRYING OUT THE INVENTION

Figure 1:
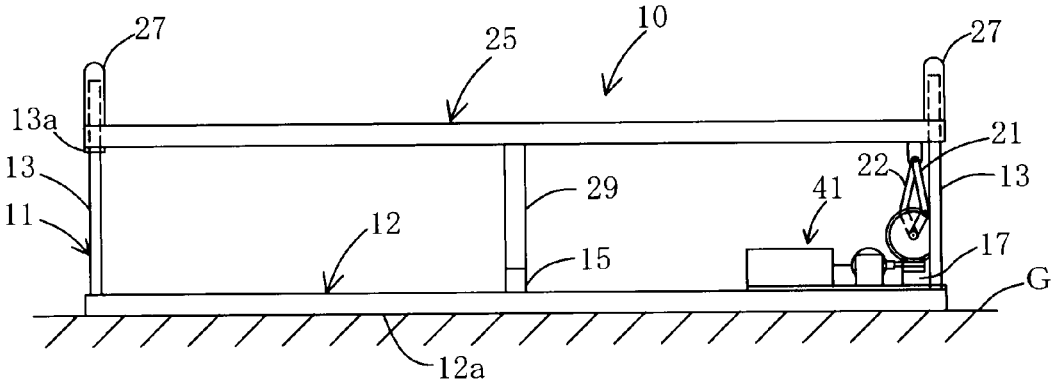
FIG. 1 is a front view showing a variable posture bed of a first embodiment of the present invention (illustration of the front side of the rotation axis support portion is omitted)
Figure 2:
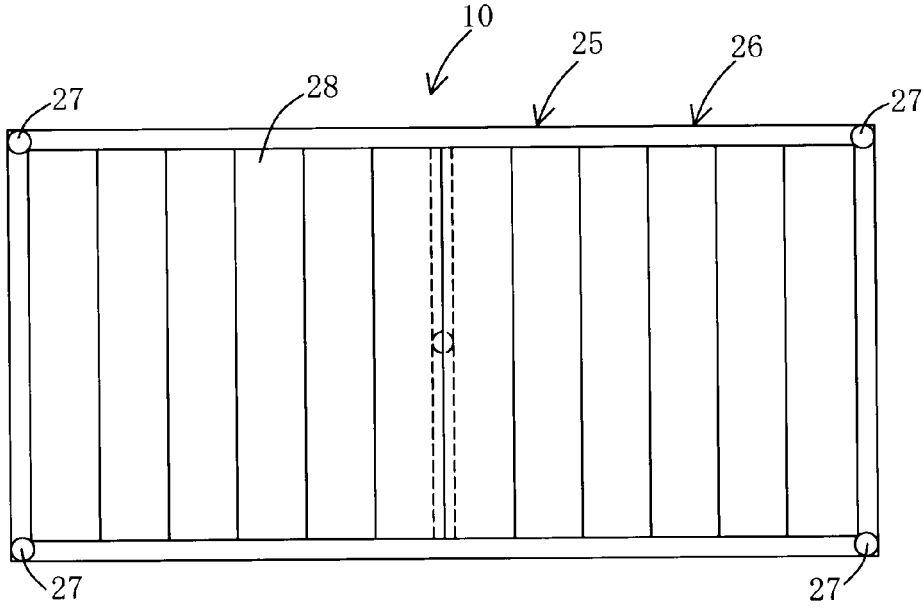
FIG. 2 is a plan view showing the variable posture bed.
Figure 3:
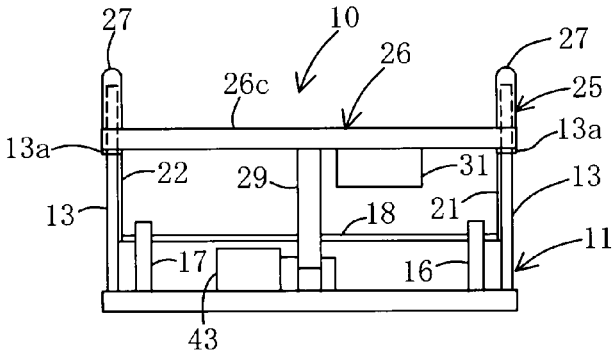
FIG. 3 is a left side view showing the variable posture bed.
Figure 4:
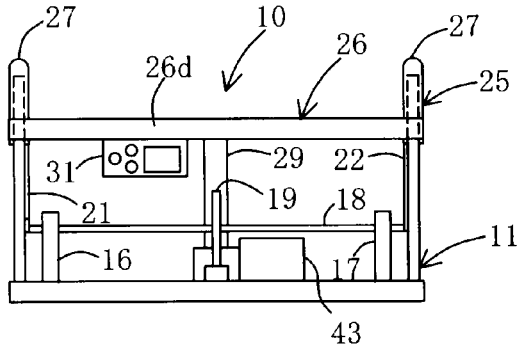
FIG. 4 is a right side view showing the variable posture bed.
Figure 5:
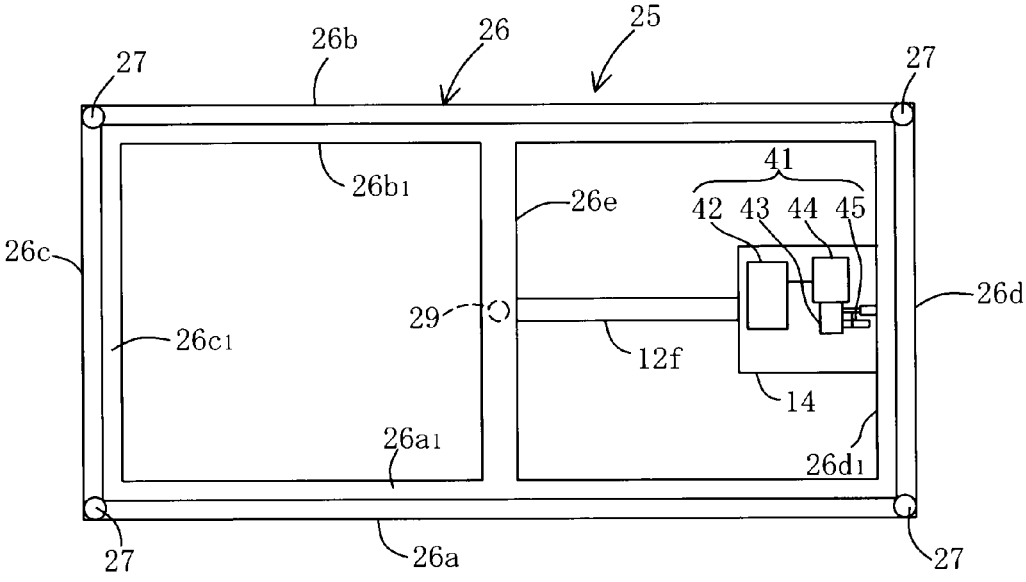
FIG. 5 is a plan view showing the variable posture bed in a state where bottom plates are removed.
Figure 6:
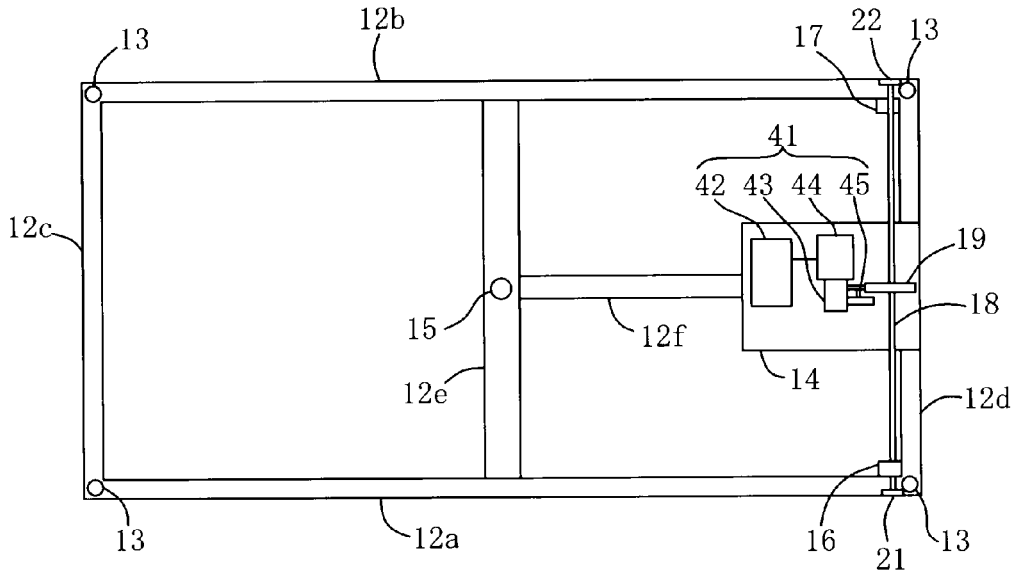
FIG. 6 is a plan view showing a base rest side of the variable posture bed.

In the following, an embodiment of the present invention will be described with reference to the drawings. FIG. 1 through FIG. 4 are respectively a front view, a plan view, a left side view and a right side view which show the general structure of a variable posture bed of a first embodiment. FIG. 5 and FIG. 6 are plan views showing states where bottom plates and a bed board of the variable posture bed are removed. In the variable posture bed 10, the bed board 25 is arranged in a horizontal state above and opposite a base rest 11 which is located on the floor surface G. The bed board 25 is supported on the base rest 11 so as to be vertically movable in all directions as its center being the moving center by upper and lower connection support portions 29, 15 which are vertically disposed at the center between the base rest 11 and the bed board 25. In addition, the bed board 25 is supported at the four corners of the base rest 11 by support members to be capable of moving vertically. The bed board 25 is continuously moved in the vertical direction in a predetermined operation pattern by a drive control device 41. The head side of the bed board 25 thereof is limited between the horizontal position and a predetermined upper position. In the first embodiment, the operating pattern is set to be a speed of 20 minutes per cycle which is suitable to be used during sleeping. In FIG. 1 and FIG. 2, the left side in the lengthwise direction of the variable posture bed 10 is the head side and the right side is the foot side.

Figure 7:
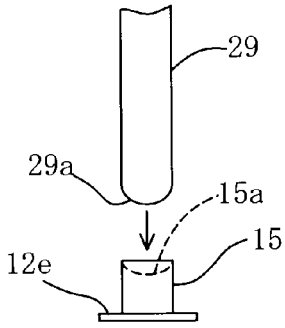
FIG. 7 is an explanatory illustration explaining the relation between an upper connection support portion and a lower connection support portion.

As shown in FIG. 6, the base rest 11 has a base portion 12 which is rectangular frame-shaped and four pillar portions 13 which are made of metal pipes being vertically arranged at the four corners of the base portion 12. The base portion 12 is formed to be frame-shaped with a front side portion 12*a*, a rear side portion 12*b*, a left side portion 12*c* and a right side portion 12*d* which are long steel plates. A lower center portion 12*e* which connects the front side portion 12*a* and the rear side portion 12*b* is disposed at the center in the lengthwise direction. Further, a middle portion 12*f* which connects middle positions of the lower center portion 12*e* and the right side portion 12*d* is disposed. A mount plate 14 on which the drive control device 41 is mounted is disposed at the position connecting to the right side portion 12*d* of the middle portion 12*f*. A lower connection support portion 15 which slightly projects in the vertical direction is disposed at the center position of the lower center portion 12*e* in the lengthwise direction. As shown in FIG. 7, a recessed portion 15*a* which is hemispherically recessed is formed at the upper end of the lower connection support portion 15. A hemispherically projecting portion 29*a* at the front end of an upper connection support portion 29 which is described later is to be fitted thereto.

Figure 9:
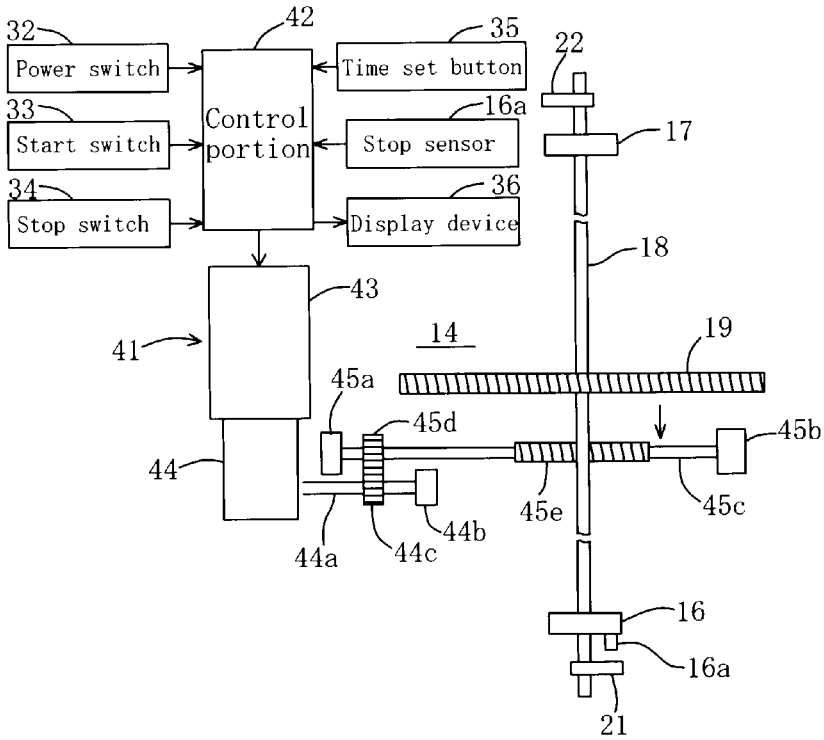
FIG. 9 is an explanatory illustration showing a schematic structure of drive parts including the drive control device.

Rotating shaft support portions 16, 17 are disposed at the front side portion 12*a* and the rear side portion 12*b* in the vicinity of the left side portion 12*c* and the right side portion 12*d*. The rotating shaft support portions 16, 17 provide a mount hole (not shown) with a bearing structure at the upper end thereof. A rotating shaft 18 is inserted to the mount hole and rotatably supported. Further, as shown in FIG. 9, a stop sensor 16*a* is attached to the outer surface in the axis direction of the left side rotating shaft support portion 16 as well as next to the mount hole. A photoelectric sensor, a magnetic sensor or the like is utilized for the stop sensor 16*a*. The stop sensor 16*a* detects the later-described rotation conversion arm 21 to be at the perpendicular position and outputs a perpendicular detection signal. A locating support portion 13*a* is disposed in the vicinity of the upper end of the pillar portion 13 of the head side of the base rest 11. The locating support portion 13*a* supports the bed board 25 so as not to move below the horizontal state at the head side and defines the lower limit position of the bed board 25.

Figure 8:
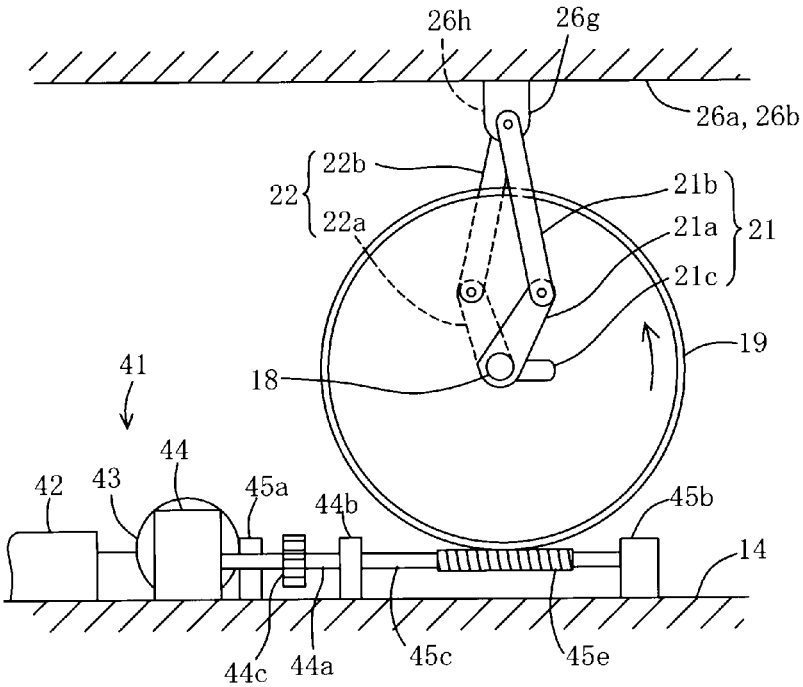
FIG. 8 is a front view showing a schematic structure of a drive control device.

An upper bevel gear 19 with a large diameter is coaxially fixed to the center of the rotating shaft 18 in the axis direction by fitting its center hole to the rotating shaft 18. The rotation conversion arms 21, 22 are attached at both ends of the rotating shaft 18 in the axis direction outside the rotating shaft support portions 16, 17. As shown in FIG. 8, the rotation conversion arms 21, 22 includes a lower arms 21*a*, 22*a* which is a long metal arm having one end fixed to the rotating shaft 18 and upper arms 21*b*, 22*b* which are a long metal arm having one end overlapped with the other end of the lower arms 21*a*, 22*a*. The length of the upper arms 21*b*, 22*b* is about twice the length of the lower arms 21*a*, 22*a*. The arms 21*a*, 22*a* and 21*b*,22*b* are connected pivotally to each other. The other end of the upper arms 21*b*, 22*b* is pivotally attached to the later-described mount hinges 26*g*, 26*h* which are disposed at the bed board 25. A locating arm 21*c* which is horizontally prolonged from the lower arm 21*a* in the right direction at the initial position where the rotation conversion arm 21 is extended almost in the vertical direction is disposed at the attaching position of the lower arm 21*a* of the left side to the rotating shaft 18.

As shown in FIG. 5, the bed board 25 has a substrate portion 26 which is rectangular frame-shaped and has four accommodating pillar portions 27 which are made of metal hollow-pipes being vertically arranged at the four corners of the substrate portion 26. The substrate portion 26 is formed to be frame-shaped with a front side portion 26*a*, a rear side portion 26*b*, a left side portion 26*c* and a right side portion 26*d* which are long steel plates. An upper center portion 26*e* which connects the front side portion 26*a* and the rear side portion 26*b* is disposed at the center in the lengthwise direction. The front side portion 26*a*, a rear side portion 26*b*, a left side portion 26*c* and a right side portion 26*d* are all folded at a right angle at the midpoint in the widthwise direction and further folded at a right angle at the center in the widthwise direction of the folded part so as to extend horizontally. Accordingly, inner portions 26*a*1 through 26*d*1 which have stepped portions recessed downward against the outer part are formed. The bed board 25 is formed by arranging a plurality of long bottom plates 28 on the recessed inner portions 26*a*1 through 26*d*1 so that a person can lie on the bottom plates 28. Further, the mount hinges 26*g*, 26*h* are attached extendedly downward at the front side portion 26*a* and the rear side portion 26*b* above the both ends of the rotating shaft 18.

The lower end of the accommodating pillar portion 27 is opened and the upper end is hemispherically projected to be hemispherical. The front end side of the pillar portion 13 is inserted to the hollow part of the accommodating pillar portion 27. The pillar portion 13 and the accommodating pillar portion 27 configure the support member to support the bed board 25 being capable of moving vertically. Since the upper end of the pillar portion 13 and the upper end of the accommodating pillar portion 27 are spaced at a predetermined distance in the state where the bed board 25 is horizontal, the accommodating pillar 27 can vertically move along the pillar portion 13. Here, the lower limit of the inclination of the bed board 25 is the state where the upper end of the pillar portion 13 and the upper end of the accommodating pillar portion 27 are contacted at the foot side of the bed board 25. In other words, the predetermined distance between the upper end of the pillar 13 and the upper end of the accommodating pillar portion 27 defines the vertically movable range of the bed board 25.

Further, an upper connection support portion 29 which extends downward in the vertical direction is disposed at the center position at the upper center portion 26*e* in the lengthwise direction. The upper connection support portion 29 which configures a connection support portion along with the lower connection support portion 15 is arranged on the same vertical line with the lower connection support portion 15. The projecting portion 29*a* which is projected being hemispherical is formed at the lower end of the upper connection support portion 29 and fitted to the hemispherical recessed portion 15*a* at the front end of the lower connection support portion 15. Since the projecting portion 29*a* at the bottom end of the upper connection support portion 29 and the recessed portion 15*a* of the upper end of the lower connection support portion 15 are thereby smoothly engaged, the upper connection support portion 29 is smoothly inclined in all directions around the bottom end thereof. As mentioned above, since the accommodating pillar portion 27 is capable of vertically moving along the pillar portion 13, the bed board 25 is capable of vertically moving in all directions around the upper and lower connection support portions 29, 15.

An operation panel 31 is attached at the left side of the right side portion 26*d*. The operation panel 31 has a power switch 32 to start powering the drive control device 41, a start switch 33 to start the operation of the bed board 25, a stop switch 34 to stop the operation of the bed board 25, a time set button 35 to set the operating time of the bed board 25 and a display device 36 to display the operation time of the bed board 25.

Figure 11:
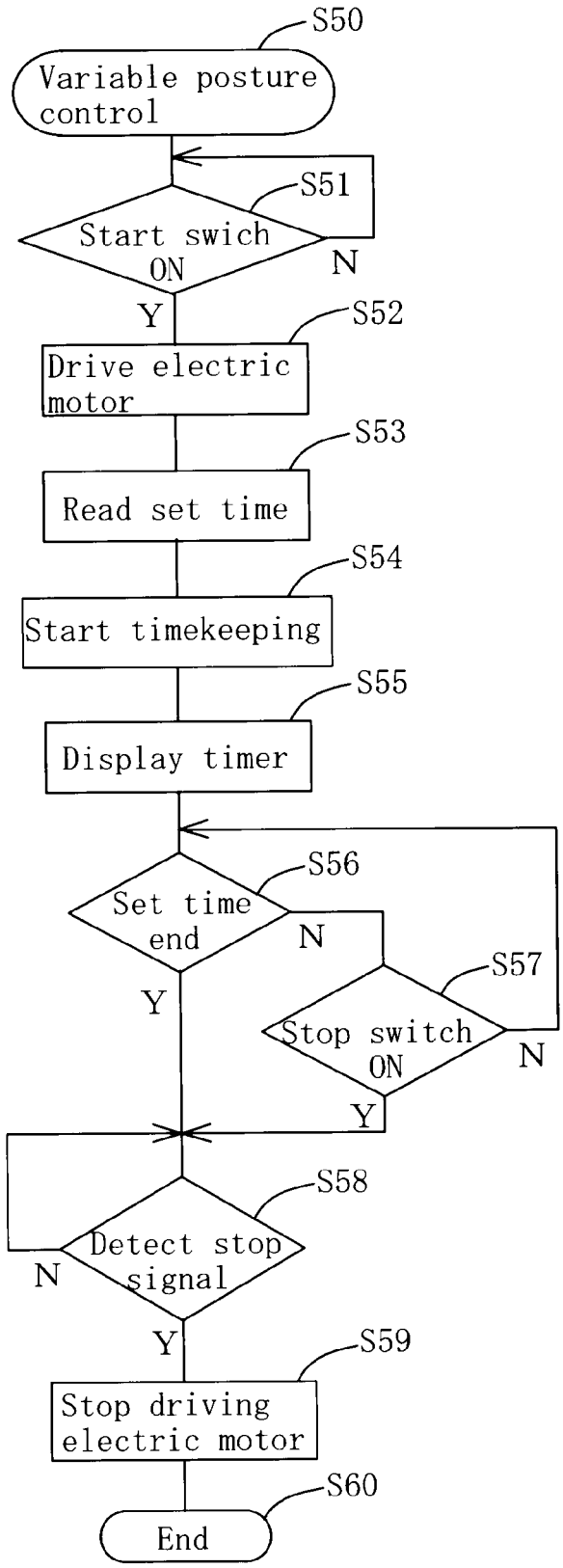
FIG. 11 is a flowchart of a variable posture control program which is executed by the control portion.

As shown in FIG. 5, FIG. 8 and FIG. 9, the drive control device 41 is configured by a control portion 42, an electric motor 43, a rotation conversion portion 44 and a rotation transmission portion 45. The control portion 42 has a microcomputer and performs "a variable posture control program" which is shown in FIG. 11. The power switch 32, the start switch 33, the stop switch 34, the time set button 35 and the stop sensor 16*a* are connected to the input side of the control portion 42. Further, the display device 36 and the electric motor 43 are connected to the output side of the control portion 42. Here, the control portion 42 is not limited to a digital type, but may also be an analog type.

The rotation conversion portion 44 outputs the rotation to an output shaft 44*a* after converting the rotation of the electric motor 43 into the rotation in the direction perpendicular to the axial direction. The front end of the output shaft 44*a* is rotatably supported by an output support portion 44*b* which is mounted at the mount plate 14. A spur gear 44*c* is fixed at the middle part of the output shaft 44*a*. In the rotation transmission portion 45, a conversion shaft 45*c* which is rotatably supported at both ends by transmission support portions 45*a*, 45*b* disposed at the mount plate 14 is arranged to be parallel to the output shaft 44*a*. A spur gear 45*d* which is engaged with the gear 44*c* is attached at the vicinity of the transmission support portion 45*a* of the conversion shaft 45*c*. A bevel gear 45*e* is attached at the conversion support portion 45*b* side of the conversion shaft 45*c* to be parallel to the axis direction. The upper gear 19 is arranged to engage with the gear 45*e*. Here, the upper gear 19 is arranged to be apart from the gear 45*e* in FIG. 9 for ease of illustration. However, in actuality, the upper gear 19 is engaged with the upper part of the gear 45*e* which has moved in the arrow direction. Accordingly, the rotation of the gear 45*e* is converted into the orthogonal rotation of the upper gear 19.

Next, the operation pattern of the bed board 25 which is driven by the electric motor 43 is described with reference to FIG. 10A through FIG. 10D. In FIG. 10A through FIG. 10D, the upper side is a schematic plan view of the bed board and the lower side is a schematic front view, respectively. The left side of the drawing is the head side and the right side is the foot side. Here, in the drawings, symbol K shows the reference position when the bed board is in a horizontal state. Symbol H shows the upper limit position and symbol L shows the lower limit position.

The rotation of the electric motor 43 is outputted as the rotation of the output shaft 44*a* after being converted into the orthogonal rotation by the rotation conversion portion 44. The rotation of the output shaft 44*a* is transmitted to the rotation of the conversion shaft 45*c* by the gear 44*c* via the gear 45*d*. The rotation of the conversion shaft 45*c* is transmitted to the rotation of the upper gear 19 via the gear 45*e*. The rotating shaft 18 is rotated by the rotation of the upper gear 19. The rotation conversion arms 21, 22 which are attached to the rotating shaft 18 are moved by the rotation of the rotating shaft 18. In the initial state in which the rotation conversion arms 21, 22 are fully extended as shown in FIG. 6, the bed board 25 is almost horizontal at the reference position K (see FIG. 10A). When the rotation conversion arm 22 is bent due to the rotation of the rotating shaft 18, the foot-rear side end part of the bed board 25 is pulled downward. Accordingly, the foot-rear side of the bed board 25 is moved downward and the head-front side which is the diagonal side is moved upward. Further, when the rotation conversion arm 22 overlaps below the rotating shaft 18, the foot-rear side of the bed board 25 reaches the lower limit position L and the head-front side reaches the upper limit position H (see FIG. 10B).

When the rotation conversion arm 21 is bent due to the pivoting following the rotation conversion arm 22, the foot-front side of the bed board 25 moves downward and the head-rear side which is the diagonal side moves upward. Accordingly, the foot-front side of the bed board 25 also reaches the lower limit position L and the head-rear side also reaches the upper limit position H (see FIG. 10C). Further, when the rotation conversion arm 22 is contrarily extended upward by the rotation of the rotating shaft 18, the foot-rear side of the bed board 25 is pushed upward. Accordingly, the foot-rear side of the bed board 25 moves upward and the head-front side which is the diagonal side moves downward. In the state where the rotation conversion arm 22 is fully extended, both of the foot-rear side and the head-front side of the bed board 25 are returned to the horizontal reference position K (see FIG. 10D). The rotation conversion arm 21 is extended due to the pivoting following the rotation conversion arm 22, and the foot-front side of the bed board 25 moves upward and the head-rear side which is the diagonal side moves downward accordingly. In the state where the rotation conversion arm 21 is fully extended, both of the foot-front side and the head-rear side of the bed board 25 are returned to the horizontal reference position K. Accordingly, the whole bed board 25 returns to the horizontal state and a series of the operation patterns ends (see FIG. 10A). In the first embodiment, the rotation conversion arms 21, 22 are moved by driving the rotation conversion portion 44 and the rotation transmission portion 45 by the single electric motor 43. Strictly speaking, therefore, the vertical movement of the bed board 25 is slightly shifted from FIG. 10A through FIG. 10D. However, these drawings are to explain a general tendency of the vertical movement of the bed board 25.

Next, the operation of the first embodiment will be described.

Figure 10A:
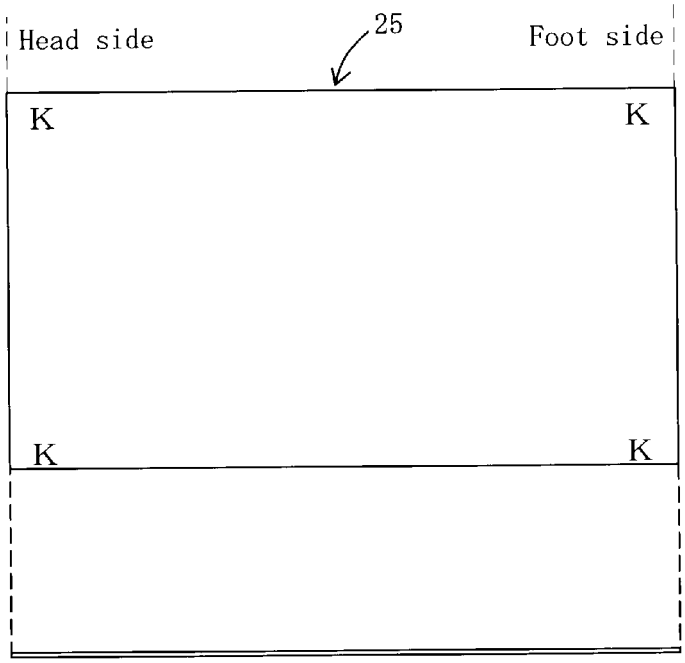
FIG. 10A through FIG. 10D are schematic illustrations showing sections of an operation pattern of a bed board.
Figure 10B:
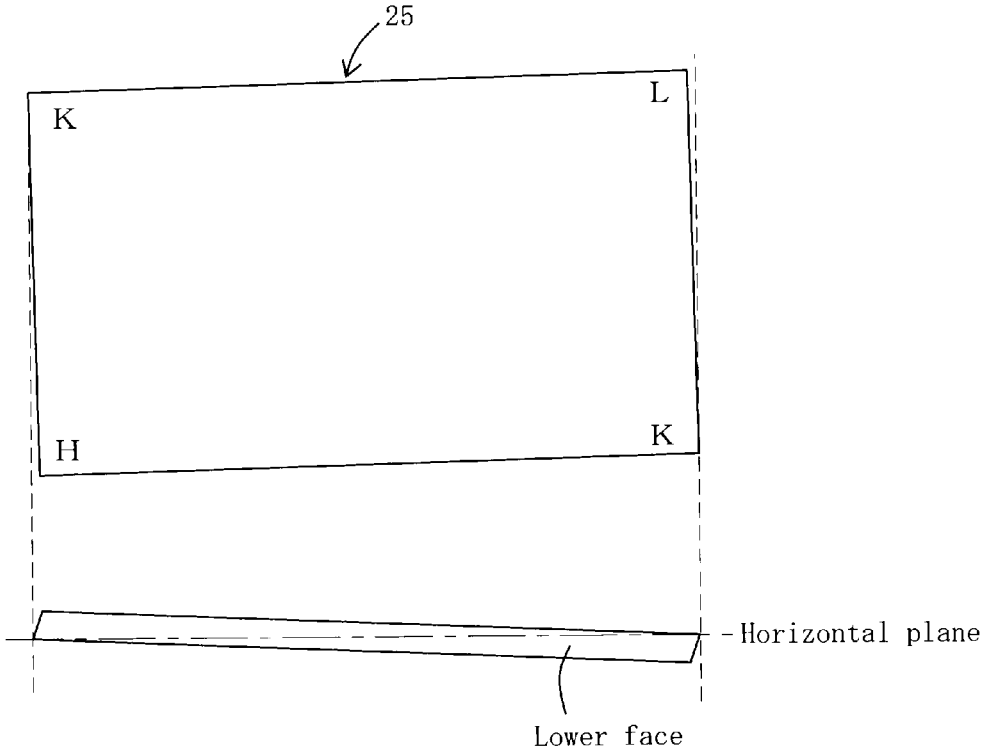
Figure 10C:
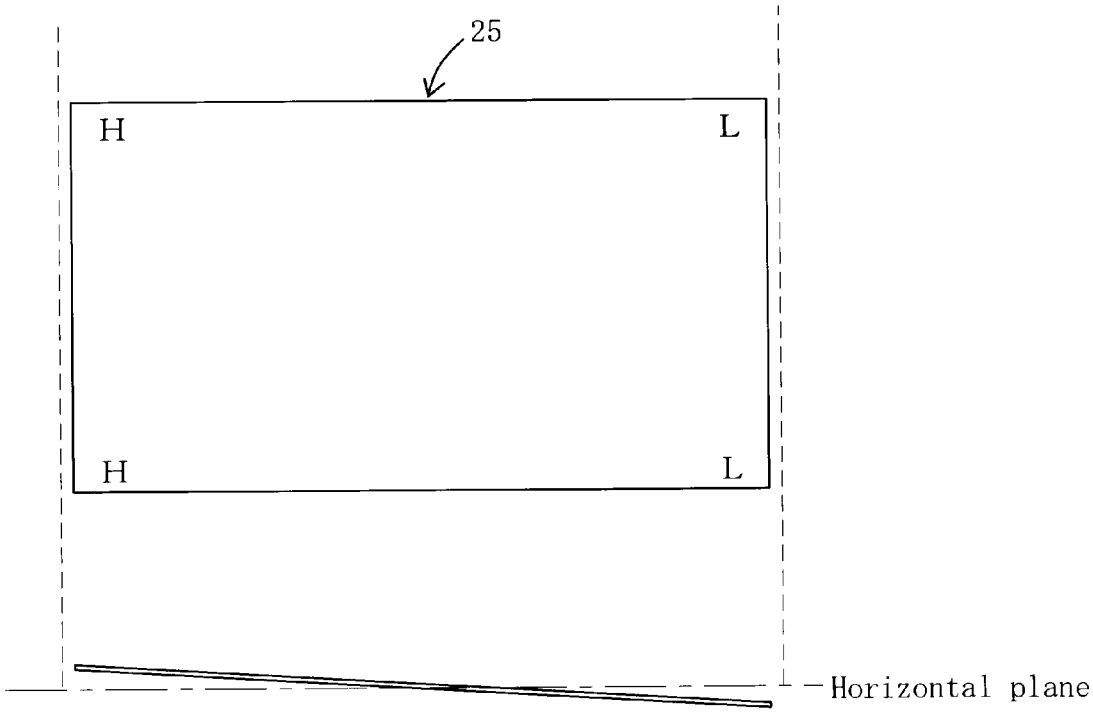
Figure 10D:
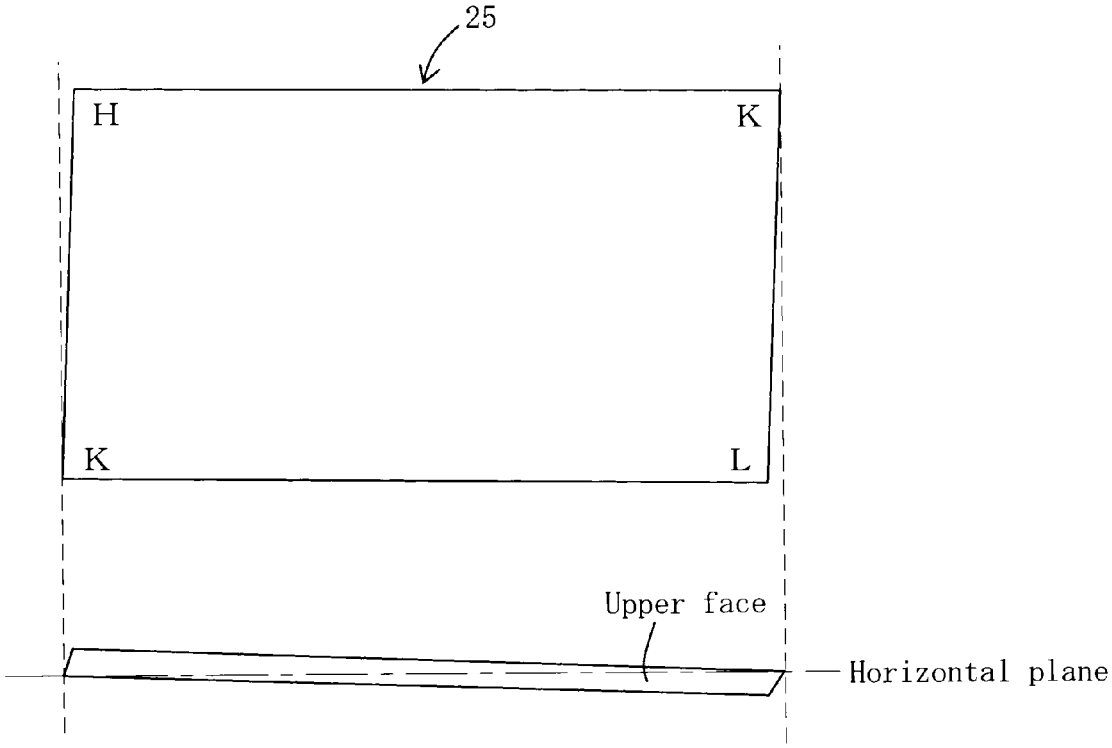

When the power switch 32 is turned on, the control portion 42 starts executing the variable posture control program (steps 50). Then, the time for the variable posture control is set by the time set button 35. When the start switch 33 is turned on, the control portion 42 correspondingly outputs an electric motor drive signal and drives the electric motor 43 (steps 51, 52). Simultaneously, the control portion 42 reads the set time, starts timekeeping and displays the elapsed time on the display device 36 (steps 53, 54, 55). The rotation of the electric motor 43 is transmitted to the upper gear 19 via the rotation conversion portion 44 and the rotation transmission portion 45. As a result, the vertical movement of the bed board 25 is started and the operation patterns are repeated. Even if the set time ends while the vertical movement of the bed board 25 is repeated, the operation of the bed board 25 by the electric motor 43 is not stopped. When the bed board 25 is returned to the horizontal state as shown in FIG. 10A, the stop sensor 16*a* detects the locating arm 21*c* which is disposed at the rotation conversion arm 21 and outputs the detection signal. Accordingly, the control portion 42 stops outputting the drive signal, driving the electric motor 43, and finishes executing the program (steps 56, 58, 59, 60). Further, even if the stop switch 34 is turned on before the set time ends, the operation of the bed board 25 by the electric motor 43 is not stopped. After the stop sensor 16*a* detects the locating arm 21*c*, the control portion 42 stops driving the electric motor 43 and finishes executing the program (steps 56, 57, 58, 59, 60). Therefore, the bed board 25 does not stop operating at midstream of the operation pattern, and stops when the bed board 25 is returned to the initial horizontal state.

In the first embodiment, the bed board 25 is supported to be capable of vertically moving in all directions by the upper and lower connection support portions 29, 15 and supported being capable of vertically moving by the pillar portions 13 and the accommodating pillar portions 27 at the four corners of the base rest 11. The bed board 25 is thereby capable of being vertically inclined at the head side and the foot side around the connection support portions 29, 15. Then, with the vertical movement of the bed board 25 at both the left and right sides of the foot side position by the drive control device 41, the bed board 25 is capable to be inclined between the horizontal position and the predetermined upper position of the head part taking the connection support portions 29, 15 as the center. According to the first embodiment, this makes it possible to perform a postural change such as a roll-over (hereinafter, described as the postural change) automatically and naturally to a person lying on the bed board 25 while always keeping his or her head at the position equal to or higher than the horizontal state.

Consequently, in the first embodiment, it is convenient because fatigue is eliminated naturally and effectively from a person lying on the bed board 25 during sleep. Further, since the head part is always kept at the position equal to or higher than the horizontal state, the brain, the semicircular canal of the ear, the otolith, and the like are not subject to negative effects and motion sickness symptoms, such as dizziness, nausea, and discomfort, do not occur. Further, since it is possible for a seriously ill person who is bedridden and unable to perform the postural change by oneself to automatically perform the postural change without care-giver's help, bedsores can be prevented. In addition, it is possible to prevent the distortion of bone structure and inhibition of blood flow and lymph flow caused by stresses on skin, muscles and internal organs, which are caused by gravity, and various diseases caused thereby can be prevented. Further, the burden of care-giver's work for performing the postural change to a serious ill person can be greatly reduced and the care-giving cost therefor can be greatly reduced.

Further, with the first embodiment, the upper connection support portion 29 and the lower connection support portion 15 are smoothly engaged at the projecting portion 29*a* at the bottom end and the recessed portion 15*a* at the upper end. The bed board 25 thereby smoothly moves in the vertical direction in all directions thereof and comfortable sleep for a sleeper can be assured. Furthermore, in the first embodiment, four corners of the bed board 25 vertically move sequentially counterclockwise or clockwise. A person lying on the bed board 25 is thereby put into a state that natural and smooth postural change is thereby performed. Therefore, the above-mentioned effects of the postural change can be further assured. Furthermore, in the first embodiment, the bed board 25 is returned to the horizontal state when the operation of the operation pattern is stopped by the drive control device 41. Since a person lying on the bed board 25 is thereby ensured not to be left in an unnaturally inclined state and to be returned to the horizontal state, the variable posture bed 10 can be safely used.

Figure 12:
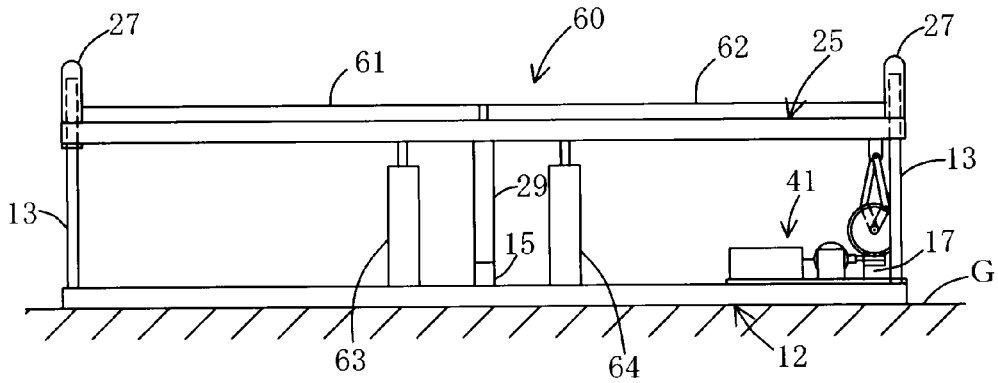
FIG. 12 is a front view of a variable posture bed of a second embodiment (illustration of the front side of the rotation axis support portion is omitted)
Figure 13:
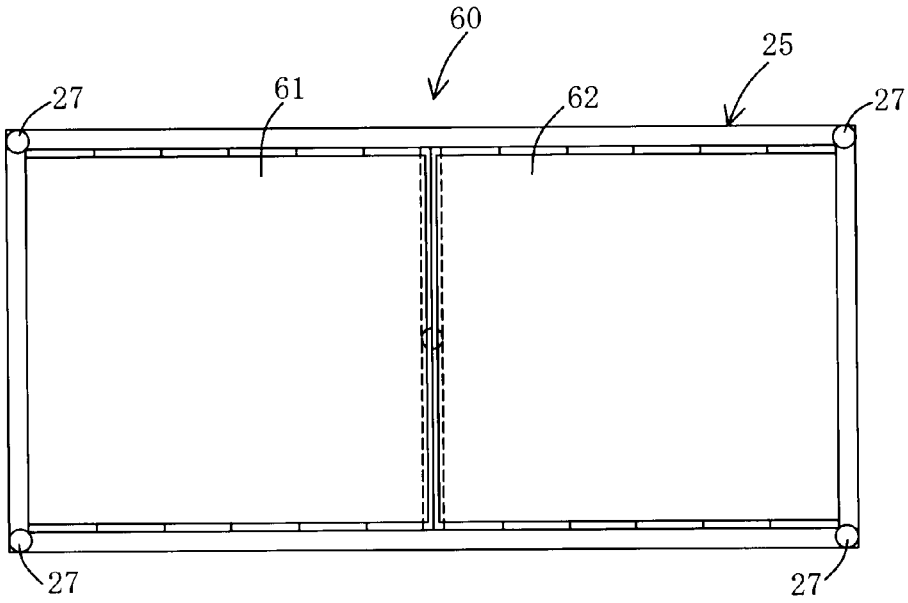
FIG. 13 is a plan view of the variable posture bed of the second embodiment.
Figure 14:
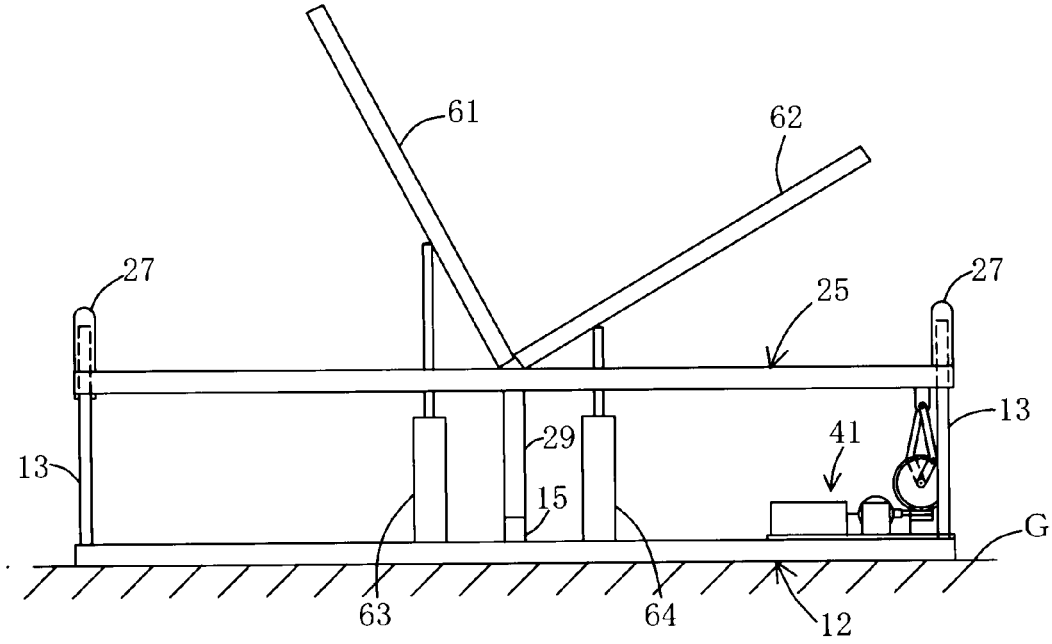
FIG. 14 is a front view which shows operation of the variable posture bed of the second embodiment (illustration of the front side of the rotation axis support portion is omitted)

Next, a second embodiment of the present invention is described. FIGS. 12 and 13 are respectively a front view and a plan view which show the variable posture bed according to the second embodiment. FIG. 14 is a front view which shows an operation state of the variable posture bed. In a variable posture bed 60, an upper body bed board 61 for the upper body side and a lower body bed board 62 for the lower body side are pivotally located on the bed board 25 of the above-mentioned variable posture bed 10 around the middle position in the lengthwise direction. An upper body drive control device 63 which has a hydraulic cylinder etc. is disposed in the vicinity of the center in the lengthwise direction of the upper body bed board 61. The upper body drive control device 63 drives and controls the upward movement and the returning to the horizontal state of the upper body bed board 61, and performs a keeping control to keep the upper body bed board 61 in a stopped state at a predetermined height position and a vertical movement control to repeatedly perform the movement between the predetermined height position and the horizontal state. A lower body drive control device 64 which has a hydraulic cylinder etc. is disposed at the vicinity of the center in the lengthwise direction of the lower body bed board 62. The lower body drive control device 64 drives and controls the upward movement and the returning to the horizontal state of the lower body bed board 62, and performs a keeping control to keep the lower body bed board 62 in a stopped state at a predetermined height position and a vertical movement control to repeatedly perform the movement between the predetermined height position and the horizontal state.

In the second embodiment, the upper body bed board 61 can be raised by the keeping control so that a person lying on the bed board 61 can have a meal etc. in a raised state. Also, the lower body bed board 62 can be raised so that a person lying on the bed board 62 is to be placed in a state of doing light exercise state by raising the lower body. Further, repeatedly moving the upper body bed board 61 or the lower body bed board 62 between the predetermined height position and the horizontal state by the vertical movement control enables a person lying on the bed to do light exercise while lying.

Figure 15:
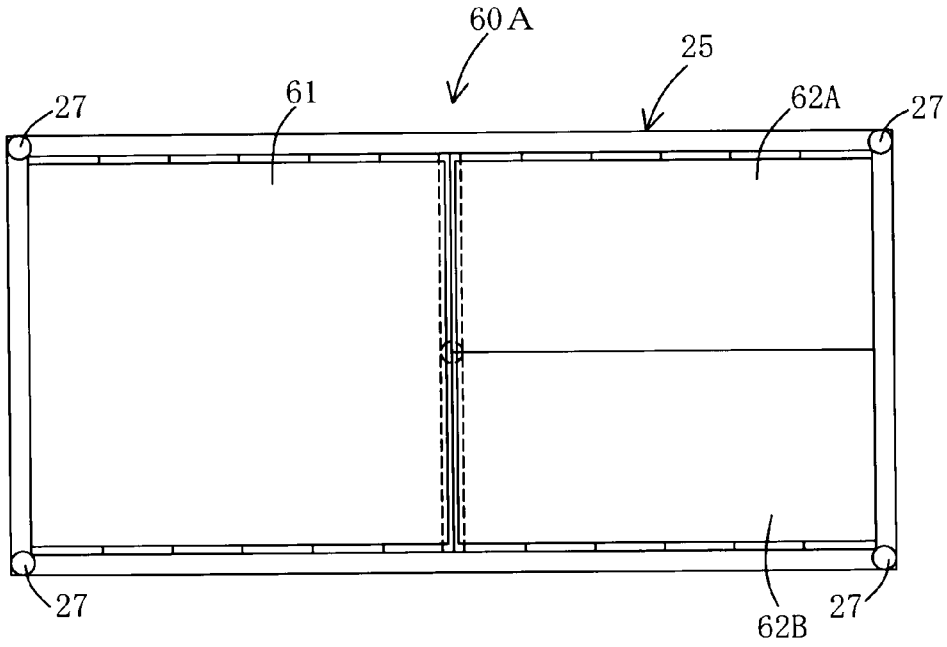
FIG. 15 is a plan view which shows a variable posture bed of a modified embodiment of the second embodiment.

Next, a modified embodiment of the second embodiment will be described with FIG. 15. In the modified embodiment, the lower body bed board of the variable posture bed 60 of the second embodiment is further divided into the left and right parts to be a left lower body bed board 62A and a right lower body bed board 62B, respectively. Left and right lower body drive control devices 65 are respectively disposed at the left and right lower body bed boards 62A, 62B. According to the modified embodiment, the left and right lower body bed boards 62A,62B can be operated simultaneously or separately. The left and right legs can be thereby exercised efficiently.

Here, in the first embodiment, the speed of the operation pattern is determined to 20 minutes per cycle. However, it is also possible to make the speed setting adjustable. The structure of the rotation transmission portion etc. becomes accordingly complicated, but it is convenient because the user of the variable posture bed can adjust the speed of the operation of the bed board corresponding to the usage state or the physical condition. For example, in a normal state where the user is awake during day time, the operation speed can be increased to about 10 minutes per cycle. Further, in the case that rollover is utilized for a light exercise of the whole body, the speed can be selected from the range between several seconds per cycle and several minutes per cycle in consideration with physical fitness and physical condition.

In the first embodiment, an electric motor is utilized in the drive control device. However, drive means is not limited to this but a hydraulic cylinder etc. can also be utilized. For the upper and lower body drive control devices, drive means is not limited to a hydraulic cylinder but other drive means can also be utilized. In addition, the variable posture beds shown in the embodiments are examples and the present invention can be actualized with various modifications in the scope without departing from the spirit of the present invention.

INDUSTRIAL APPLICABILITY

According to the variable posture bed of the present invention, the bed board is capable of vertically moving in all directions around the connection support portion. The postural change can be performed automatically and naturally to a person lying on the bed board so that the head does not fall below the horizontal state. Fatigue of the lying person is thereby naturally eliminated during sleep. Further, since it is possible for a seriously ill person who is bedridden and unable to perform the postural change by oneself to automatically perform the postural change without care-giver's help, bedsores and various diseases can be prevented. Further, the burden of care-giver's work for performing the postural change to a serious ill person can be greatly reduced. Therefore, the present invention is useful.

The invention claimed is:

1. A variable posture bed, wherein a bed board is arranged in a horizontal state above and opposite a base rest which is located on a floor surface, the bed board is supported on the base rest to be vertically movable in all directions around the center thereof by a connection support portion which is erected at the center of the base rest between the base rest and the bed board and the bed board includes a rectangular perimeter is supported at corners of the rectangular perimeter and at four corners of the base rest by support members such that the bed board is vertically movable, the bed board is configured to be moved in the vertical direction with a predetermined operation pattern while the vertical movement of a head side of the bed board is limited between the horizontal position and a predetermined upper position by a drive control device, and the operation pattern includes a series of operations of:

one side of the left or the right of the head side of the bed board moving to an upper limit position;

the other side of the left or the right of the head side moving to the upper limit position;

one side of the left or the right of the head side moving to the horizontal position; and the other side of the left or the right of the head side moving to the horizontal position.

2. The variable posture bed according to claim 1, wherein the bed board is driven by the drive control device at both the left and right sides of a foot side position or at both the left and right sides of the head side position of the bed board.

3. The variable posture bed according to claim 2, wherein the connection support portion includes a lower connection support portion which is disposed on the base rest and an upper connection support portion which is disposed on a lower surface of the bed board and which front end side is engaged with the front end side of the lower connection support portion, the front end of one of the upper connection support portion and the lower connection support portion is formed as a hemispherically projecting portion, and the front end of the other of the upper connection support portion and the lower connection support portion is formed as a hemispherically recessed portion to engage with the hemispherically projecting portion, and the upper connection support portion is made pivotable around the front end of the lower connection support portion.

4. The variable posture bed according to claim 3, wherein the bed board is returned to the horizontal state when the operation of the operation pattern is stopped by the drive control device.

5. The variable posture bed according to claim 4, further comprising speed adjustment means for adjusting the speed of the operation of the bed board performed by the drive control device.

6. The variable posture bed according to claim 5, comprising:

an upper body bed board for an upper body side and a lower body bed board for the lower body side which are located on the bed board pivotable around the middle position in the lengthwise direction as the rotation center;

an upper body drive control device which controls upward movement and returning to the horizontal state of the upper body bed board; and a lower body drive control device which controls upward movement and returning to the horizontal state of the lower body bed board.

7. The variable posture bed according to claim 6, wherein the upper body drive control device performs a keeping control to keep the upper body bed board in a stopped state at a predetermined height position and a vertical movement control to repeatedly perform the upward movement and the returning to the horizontal state, and the lower body drive control device performs a keeping control to keep the lower body bed board in a stopped state at a predetermined height position and a vertical movement control to repeatedly perform the upward movement and the returning to the horizontal state.

8. The variable posture bed according to claim 7, wherein the lower body bed board is further divided into a left body portion of the left body side and a right body portion of the right body side, and the lower body drive control device operates the left body portion and the right body portion simultaneously or separately.

9. The variable posture bed according to claim 1, wherein the connection support portion includes a lower connection support portion which is disposed on the base rest and an upper connection support portion which is disposed on a lower surface of the bed board and which front end side is engaged with the front end side of the lower connection support portion, the front end of one of the upper connection support portion and the lower connection support portion is formed as a hemispherically projecting portion, and the front end of the other of the upper connection support portion and the lower connection support portion is formed as a hemispherically recessed portion to engage with the hemispherically projecting portion, and the upper connection support portion is made pivotable around the front end of the lower connection support portion.

10. The variable posture bed according to claim 9, wherein the bed board is returned to the horizontal state when the operation of the operation pattern is stopped by the drive control device.

11. The variable posture bed according to claim 10, further comprising speed adjustment means for adjusting the speed of the operation of the bed board performed by the drive control device.

12. The variable posture bed according to claim 1, wherein the bed board is returned to the horizontal state when the operation of the operation pattern is stopped by the drive control device.

13. The variable posture bed according to claim 12, further comprising speed adjustment means for adjusting the speed of the operation of the bed board performed by the drive control device.

14. The variable posture bed according to claim 2, wherein the bed board is returned to the horizontal state when the operation of the operation pattern is stopped by the drive control device.

15. The variable posture bed according to claim 14, further comprising speed adjustment means for adjusting the speed of the operation of the bed board performed by the drive control device.

16. The variable posture bed according to claim 1, comprising:

an upper body bed board for an upper body side and a lower body bed board for the lower body side which are located on the bed board pivotable around the middle position in the lengthwise direction as the rotation center;

an upper body drive control device which controls upward movement and returning to the horizontal state of the upper body bed board; and a lower body drive control device which controls upward movement and returning to the horizontal state of the lower body bed board.

17. The variable posture bed according to claim 16, wherein the upper body drive control device performs a keeping control to keep the upper body bed board in a stopped state at a predetermined height position and a vertical movement control to repeatedly perform the upward movement and the returning to the horizontal state, and the lower body drive control device performs a keeping control to keep the lower body bed board in a stopped state at a predetermined height position and a vertical movement control to repeatedly perform the upward movement and the returning to the horizontal state.

18. The variable posture bed according to claim 17, wherein the lower body bed board is further divided into a left body portion of the left body side and a right body portion of the right body side, and the lower body drive control device operates the left body portion and the right body portion simultaneously or separately.

19. A variable posture bed comprising:

a base rest which is located on a floor surface;

a bed board which is arranged in a horizontal state above and opposite the base rest, the bed board including a rectangular perimeter;

a connection support portion which is disposed at the center of the base rest between the base rest and the bed board and which supports the bed board, at corners of the rectangular perimeter such that the bed board is vertically movable in all directions around the center thereof;

support members which are disposed at four corners of the base rest and the bed board and which supports the bed board to be vertically movable;

a drive control device which continuously moves the bed board in the vertical direction with a predetermined operation pattern and which limits the vertical movement of the head side of the bed board between the horizontal position and a predetermined upper position; and the operation pattern includes a series of operations of:

one side of the left or the right of the head side of the bed board moving to an upper limit position;

the other side of the left or the right of the head side moving to the upper limit position;

one side of the left or the right of the head side moving to the horizontal position; and the other side of the left or the right of the head side moving to the horizontal position.

20. The variable posture bed according to claim 19, wherein the bed board is driven by the drive control device at both the left and right sides of a foot side position or at both the left and right sides of the head side position of the bed board.

21. The variable posture bed according to claim 20, wherein the connection support portion includes a lower connection support portion which is disposed on the base rest and an upper connection support portion which is disposed on a lower surface of the bed board and which front end side is engaged with the front end side of the lower connection support portion, the front end of one of the upper connection support portion and the lower connection support portion is formed as a hemispherically projecting portion, and the front end of the other of the upper connection support portion and the lower connection support portion is formed as a hemispherically recessed portion to engage with the hemispherically projecting portion, and the upper connection support portion is made pivotable around the front end of the lower connection support portion.

22. The variable posture bed according to claim 21, wherein the bed board is returned to the horizontal state when the operation of the operation pattern is stopped by the drive control device.

23. The variable posture bed according to claim 22, further comprising speed adjustment means for adjusting the speed of the operation of the bed board performed by the drive control device.

24. The variable posture bed according to claim 23, comprising:

an upper body bed board for an upper body side and a lower body bed board for the lower body side which are located on the bed board pivotable around the middle position in the lengthwise direction as the rotation center;

an upper body drive control device which controls upward movement and returning to the horizontal state of the upper body bed board; and a lower body drive control device which controls upward movement and returning to the horizontal state of the lower body bed board.

25. The variable posture bed according to claim 24, wherein the upper body drive control device performs a keeping control to keep the upper body bed board in a stopped state at a predetermined height position and a vertical movement control to repeatedly perform the upward movement and the returning to the horizontal state, and the lower body drive control device performs a keeping control to keep the lower body bed board in a stopped state at a predetermined height position and a vertical movement control to repeatedly perform the upward movement and the returning to the horizontal state.

26. The variable posture bed according to claim 25, wherein the lower body bed board is further divided into a left body portion of the left body side and a right body portion of the right body side, and the lower body drive control device operates the left body portion and the right body portion simultaneously or separately.

27. The variable posture bed according to claim 19, wherein the connection support portion includes a lower connection support portion which is disposed on the base rest and an upper connection support portion which is disposed on a lower surface of the bed board and which front end side is engaged with the front end side of the lower connection support portion, the front end of one of the upper connection support portion and the lower connection support portion is formed as a hemispherically projecting portion, and the front end of the other of the upper connection support portion and the lower connection support portion is formed as a hemispherically recessed portion to engage with the hemispherically projecting portion, and the upper connection support portion is made pivotable around the front end of the lower connection support portion.

28. The variable posture bed according to claim 27, wherein the bed board is returned to the horizontal state when the operation of the operation pattern is stopped by the drive control device.

29. The variable posture bed according to claim 28, further comprising speed adjustment means for adjusting the speed of the operation of the bed board performed by the drive control device.

30. The variable posture bed according to claim 19, wherein the bed board is returned to the horizontal state when the operation of the operation pattern is stopped by the drive control device.

31. The variable posture bed according to claim 30, further comprising speed adjustment means for adjusting the speed of the operation of the bed board performed by the drive control device.

32. The variable posture bed according to claim 20, wherein the bed board is returned to the horizontal state when the operation of the operation pattern is stopped by the drive control device.

33. The variable posture bed according to claim 32, further comprising speed adjustment means for adjusting the speed of the operation of the bed board performed by the drive control device.

34. The variable posture bed according to claim 19, comprising:

an upper body bed board for an upper body side and a lower body bed board for the lower body side which are located on the bed board pivotable around the middle position in the lengthwise direction as the rotation center;

an upper body drive control device which controls upward movement and returning to the horizontal state of the upper body bed board; and a lower body drive control device which controls upward movement and returning to the horizontal state of the lower body bed board.

35. The variable posture bed according to claim 34, wherein the upper body drive control device performs a keeping control to keep the upper body bed board in a stopped state at a predetermined height position and a vertical movement control to repeatedly perform the upward movement and the returning to the horizontal state, and the lower body drive control device performs a keeping control to keep the lower body bed board in a stopped state at a predetermined height position and a vertical movement control to repeatedly perform the upward movement and the returning to the horizontal state.

36. The variable posture bed according to claim 35, wherein the lower body bed board is further divided into a left body portion of the left body side and a right body portion of the right body side, and the lower body drive control device operates the left body portion and the right body portion simultaneously or separately.

* * * * *